United States Patent [19]

Brown et al.

[11] Patent Number: 4,657,479

[45] Date of Patent: Apr. 14, 1987

[54] ROTOR TIP CLEARANCE CONTROL DEVICES

[75] Inventors: Michael Brown, Newcastle Upon Tyne; Sharon P. Martin, Derby; Andrew Seaton, York; Phillip J. Snowsill, Nottingham; Mark S. Thomas, Derby; Hywel Williams, Solihull, all of England

[73] Assignee: Rolls-Royce plc, London, England

[21] Appl. No.: 783,159

[22] Filed: Oct. 2, 1985

[30] Foreign Application Priority Data

Oct. 9, 1984 [GB] United Kingdom ..... 8425480

[51] Int. Cl.[4] ..... F01D 11/08

[52] U.S. Cl. ..... 415/138; 415/174; 415/127

[58] Field of Search ..... 415/134, 135, 136, 137, 415/138, 171, 174, 127

[56] References Cited

U.S. PATENT DOCUMENTS

| | | | |
|---|---|---|---|
| 930,908 | 8/1909 | Westinghouse | 415/136 |
| 1,593,031 | 7/1926 | Parsons et al. | 415/135 |
| 2,416,268 | 2/1947 | Nagler | 415/171 |
| 3,740,168 | 6/1973 | Hug et al. | 415/135 |
| 4,248,569 | 2/1981 | Thebert | 415/138 |
| 4,312,599 | 1/1982 | Darolia | 415/137 |
| 4,400,135 | 8/1983 | Thebert | 415/134 |
| 4,472,108 | 9/1984 | Pask | 415/174 |
| 4,576,548 | 3/1986 | Smed et al. | 415/174 |

FOREIGN PATENT DOCUMENTS

| | | | |
|---|---|---|---|
| 2422533 | 12/1974 | Fed. Rep. of Germany | 415/136 |
| 701576 | 12/1953 | United Kingdom | 415/116 |
| 1363897 | 8/1974 | United Kingdom | 415/136 |

*Primary Examiner*—Abraham Hershkovitz
*Assistant Examiner*—John Kwon
*Attorney, Agent, or Firm*—Cushman, Darby & Cushman

[57] ABSTRACT

A shroud for a gas turbine engine rotor stage is divided into a number of arcuate segments each of which is a trapezium. The segments are urged together by compression springs which attempts to make the assembly lengthen peripherally, by virtue of the chamfered ends 30 of the segments riding up each other. The completely circular shape of the shroud prevents that movement but as a result, a hoop load is generated which tends to move the segments radially outwards, thus achieving the same effect, along with a consequent increase in diameter. A cam ring and pins are used to control and reverse the movement, as desired. The shroud diameter can thus be altered to suit rotor expansion and contraction.

11 Claims, 7 Drawing Figures

ROTOR TIP CLEARANCE CONTROL DEVICES

This invention relates to the maintainance of a desired clearance between the tips of blades which together make up a rotor, and the shroud which surrounds the rotor. More specifically, the invention relates to a device the use of which enables maintainance of the clearance.

It is known to divide a shroud which in situ, surrounds a rotor, into a number of arcuate segments. The known division is along lines which are parallel with and symmetrically about radial planes which pass through the centre of each respective segment and the rotor axis. Wedges are normally provided between adjacent ends of pairs of segments to fill the gap which otherwise would exist between them, and the segments are manipulated so as to move radially of the rotor, in accord with expansion and contraction of the rotor. By such means is the blade tip clearance between rotor and shroud more or less maintained.

The invention seeks to provide an improved device with which to achieve a substantially constant blade tip clearance as hereinbefore defined.

According to the present invention an annular shroud which in operation coaxially surrounds and is supported relative to a rotor in radially spaced relationship comprises a number of end to end abutting segments, said ends of each segment being chamfered so as to converge in a direction generally axially of the annular shroud, means urging the segments together in a direction axially of the shroud whereby the generate a hoop load in the shroud via the ends of the segments for moving the segments radially outwards and means for controlling the radially outwards movement.

Preferably the annular shroud is supported in a casing which in operation is fixed relative to the shroud and the urging means engages a wall of the casing and each segment via its longest side.

The urging means may comprise resilient means.

For example the urging means may comprise compression springs.

Preferably the means for controlling the radially outwardly movement of the segments comprises abutments acting radially inwards on the segments and which are displacable so as to enable or cause movement of the segment radially of the shroud axis.

The abutments may comprise pins having stems which are radially aligned with respect to the shroud so that inner ends of the pins abut the segments and the outer ends thereof abut pin displacement means externally of the shroud.

Preferably the abutting ends of the segments have opposing, radially aligned grooves therein and the pins lie in said grooves with their radially inner-ends abutting the grooves.

The radially inner end of each pin may include a bar which with the stem of the pin forms a 'T' and said bar locates in opposing grooves in the abutting ends, which grooves are normal to the radially aligned grooves and the bar abuts the sides thereof.

Preferably the pin displacement means comprises a cam ring mounted coaxially of the shroud and encircling the outer ends of the pins for movement relative thereto and adapted so that when moved, the cam ring exerts or reduces a radially inwardly directed force on the pins.

Preferably the cam ring is rotatable about the axis of the shroud.

The cam ring may comprise an internal surface having scallops therein which are spaced so that during operation, the cam ring when rotated relative to the pins aligns said scallops with or moves the scallops from the radially outer ends of respective pins.

Preferably the shroud is adapted and arranged for operation in association with a gas turbine engine.

Preferably the shroud is adpated and arranged to surround and operate with a turbine rotor of a gas turbine engine.

The invention will now be described, by way of example and with reference to the accompanying drawings in which.

Figure 1:
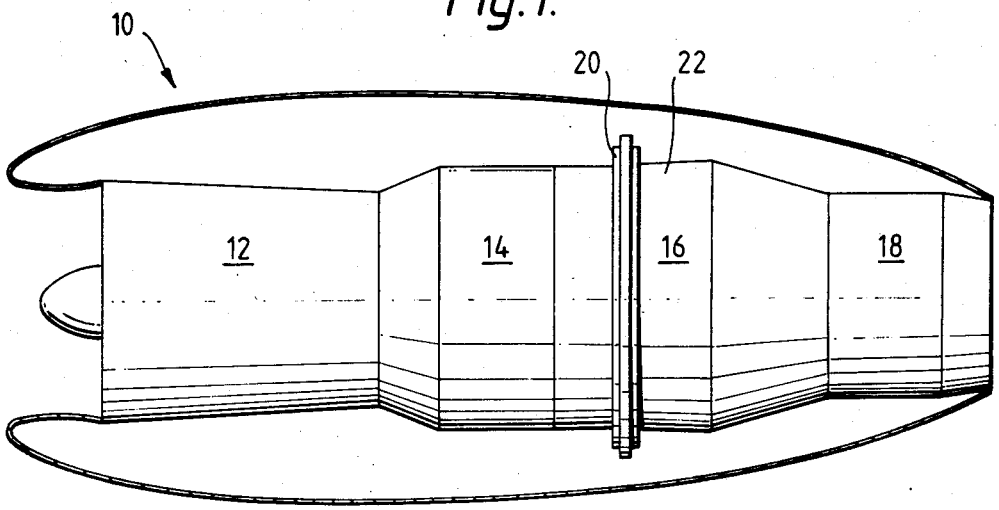
FIG. 1 is a diagrammatic view of a gas turbine engine incorporating an embodiment of the invention.

Referring to FIG. 1. A gas turbine engine 10 has a compressor 12, combustion equipment 14, a turbine section 16 and an exhaust pipe 18.

Figure 4:
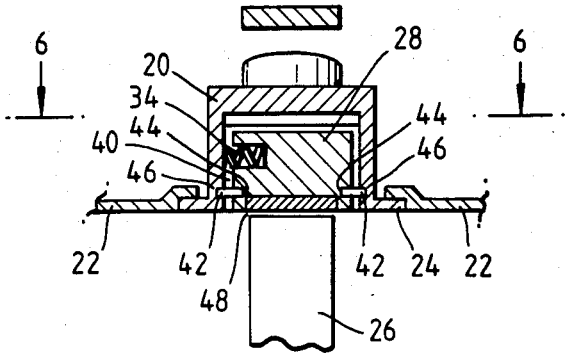
FIG. 4 is a view on lines 4—4 of FIG. 2.

A portion of the turbine section 16 is surrounded by casing 20 which is fixed to the main turbine casing 22 and, with brief reference here to FIG. 4, straddles an annular gap 24 in the main turbine casing 22, in radial alignment with a rotory stage of turbine blades 26. Still referring to FIG. 4, the casing 20 contains a ring of arcuate segments 28 shown in FIG. 4, and which are better seen as such in FIG. 2, to which reference is now made.

Figure 2:
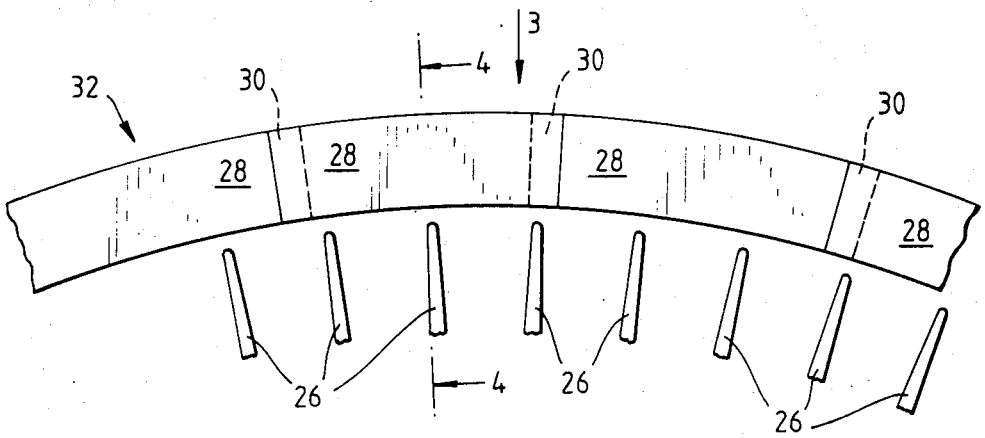
FIG. 2 is an enlarged part view of an embodiment of the invention.

In FIG. 2, each segment 28 abuts the next adjacent segment 28 by an end face 30. There results a complete ring the magnitude of the inner diameter of which is such as to be closely spaced from the tips of the stage of turbine blades 26 and this provides a shroud 32 therefor.

Figure 3:
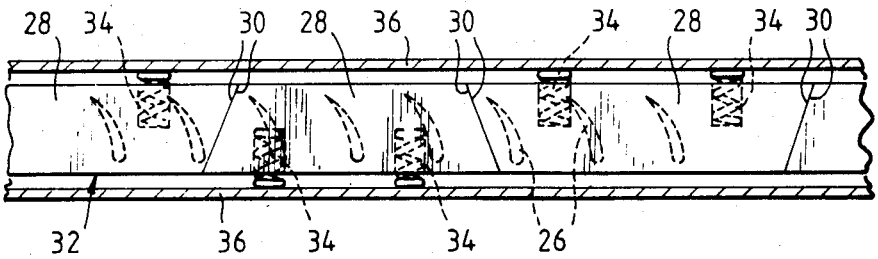
FIG. 3 is a view in the directing arrow 3 in FIG. 2.

Referring now to FIG. 3. Each segment 28 is in the shape of a trapezium in arcuate planes which are coaxial with the axis of the shroud 32 and are urged together on their ends by coil springs 34 which react against the inner surfaces of the walls 36 of the casing 20.

The abutting action of the segments 28 generates forces which attempt to push each segment 28 in a direction axially of the entire shroud 32. This is in turn generates, through the angled ends of the segments 28 a resultant force in a direction circumferentially of the shroud 32 which, if the segment 28 could move, would peripherally lengthen the shroud 32. The abutting ends 30 however, prevent such movement and cause the generation of a hoop load which acts on the segments in directions outwards of the shroud 32 to move them thus and so increases the inner diameter of the shroud 32.

Referring again to FIG. 4, the segments 28 are spaced from the casing 20 so as to permit movement thereof relative to the casing 20 as described hereinbefore. In operation in a gas turbine engine however, the space 40 so provided, would permit the ingress of hot gases.

Seals 42 in the form of strips are therefor provided, which fit into opposing slots 44, 46 in the casing 20 and segment 28 respectively.

During operation of the gas turbine engine 10 of FIG. 1, it is important that the clearance 48 between the tips of the turbine blades 26 and the inner surface of the shroud 32 remains substantially constant. This requirement applies at start up of the engine when cold, through acceleration to constant speed ie, at cruise of an aircraft powered by the engine 10 and deceleration on landing of that aircraft (not shown).

The segments 28 are so proportioned, that when they are assembled in abutting relationship, if they were not loaded by the springs 34, they would form a shroud 32, the inner diameter of which is correctly spaced from the tips of the turbine blades 26 when the associated engine 10 is cold. The segment 28 are loaded however, and means to be described hereinafter are provided, to counter and control the resulting attempts to achieve outwards movement thereof.

Figure 5:
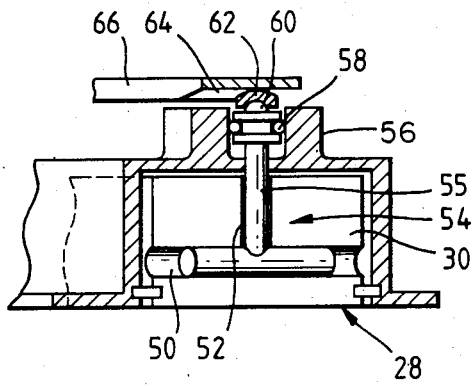
FIG. 5 is a view in the direction of arrow 5 of FIG. 6.
Figure 6:
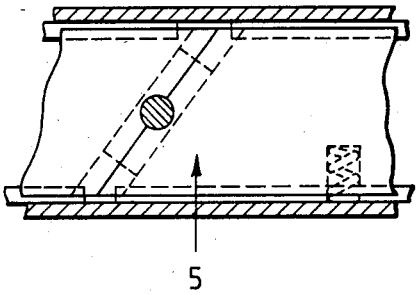
FIG. 6 is a view on line 6—6 of FIG. 4.

Referring now to FIG. 5, the adjacent ends 30 of the segments 28 each have a groove 50 and a groove 52 in its abutment surfaces. An inverted 'T' shaped pin 54 is positioned in the opposing grooves and the radially outer end of the stem 55 of the inverted 'T' pin projects beyond the segments and into the bore of a boss 56 on the casing 20. An annular seal 58 prevents egress of hot gases from the boss 56.

The protruding end 60 of each stem 55 has a friction pad 62 thereon, which engages a respective scallop 64 cut into the inner surface of a rotatable cam ring 66, there being one scallop 64 for each 'T' shaped pin 54. The cam ring 66 is rotatable by any suitable operating means eg, pneumatic, hydraulic or mechanical means none of which are shown. A mechanical drive eg, could include a screw attached to fixed structure on the engine 10 and rotatable in a nut attached to the cam ring 66, so as to impart a force through the nuts to the cam ring 66 in a peripheral direction.

In operation of engine 10, on start up thereof, the cam ring 66 is positioned so as to urge the 'T' shaped pins 54 radially inwards to press in the bottoms of their respective grooves 50 in the segment 28 of the shroud 32, so as to ensure that the segments 28 together defines the smallest required inner diameter. On increase in engine operating temperature and speed of rotation of the turbine blades 26, the blades 26 will extend radially outwardly. The cam ring 66 is rotated to bring the scalloped surfaces 64 over the outer ends 60 of the pin stems 55. The segments 28 are thus able to move radially outwards under the hoop load exerted thereon by the spring 34 to retain the clearance between the tips of the blades 26 and the shroud 32 formed by the segments 28.

The speed and magnitude of movement of the cam ring 66, and therefor the segments 28, will be dictated by the speed of growth of the turbine blades, relative to that of the surrounding structure. There are a number of known methods of monitering turbine blade growth and generating signals which may be utilised to actuate a mechanism which in turn moves a shroud surrounding the blades. For example, one method includes the placing of a capacitance device in the shroud, over the tops of the blades, which enables the monitering of the change in capacitance which occurs as the blade tips approach the device. Signals are derived from the said change and utilised directly or indirectly to actuate the means which enables or causes movement of the shroud. Such a device will be suitable for achieving movement of the shroud of the present invention.

On slowing and cooling of the associated engine 10, the turbine blades 26 contract and the capacitance consequently increases in magnitude. The signals generated then act, directly or indirectly, to return the cam ring 66 to its original position. An end load is therefore applied by the scallops 64 to the pins 50 and causes them to push the segments 28 radially inwards against the hoop loads, to their original positions.

The magnitude of radially outward movement of the segments 28 in the present example is in the range 0.012 inches to 0.015 inches. (0.3 mm 0.6 mm). In experiments on a rig, it has been found possible to achieve such movement from a nominal maximum shroud inner diameter of 24 inches (61 cm).

Figure 7:
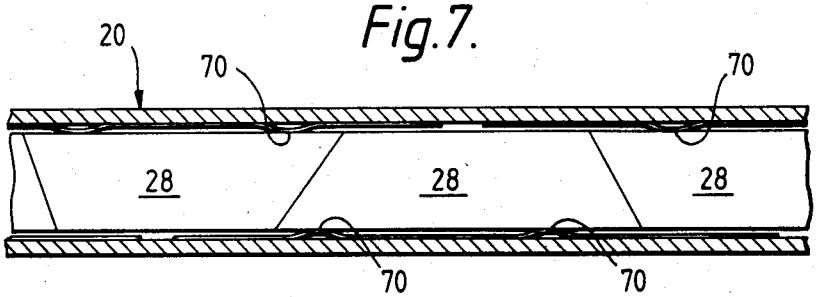
FIG. 7 is an alternative embodyment of the invention.

Referring now to FIG. 7. Leaf springs 70 are substituted for the coil springs 34 of FIG. 3 for the purpose of urging the segments towards each other so as to generate the desired hoop load as described hereinbefore.

In this specification the word "trapezium" has been used in the context of a quadrilateral which has two parallel sides. In the U.S.A. however, such a shape is known as trapezoidal.

We claim:

1. An annular shroud mounted within a fixed casing and coaxially surrounding and supported relative to a rotor in radially spaced relationship, said annular shroud comprising:

a plurality of arcuate abutting segments, each of said arcuate segments having chamfered ends arranged to converge in a direction generally axially of the annular shroud, and causing each segment to have a long end face and a short end face which lie in radial plneas transverse of the axis of the shroud, each of said ends abutting an end of an adjacent one of said arcuate segments;

means urging said arcuate segments together in a direction axially of said annular shroud and causing a resultant hoop load to be generated in said annular shroud through the abutting ends of said arcuate segments to thereby cause said arcuate segments to have radially outward movement; and means for controlling said radially outward movement of said arcuate segments.

2. An annular shroud as claimed in claim 1 in which said fixed casing includes radial wall means and in which said urging means is positioned between said wall means and said long end face of each segment to urge said segment in an axial direction.

3. An annular shroud as claimed in claim 2 wherein the urging means comprises resilient means.

4. An annular shroud as clained in claim 3 wherein the resilient means comprises compression springs.

5. An annular shroud as claimed in claim 1 wherein the means for controlling the radially outward movement of the segments comprises abutments acting radially inwardly on the segments and which are displacable so as to enable or cause movement of the segments radially of the shroud axis.

6. An annular shroud as claimed in claim 5 wherein the abutments comprise pins having stems which are radially aligned with respect to the shroud so that inner ends of the pins abut the segments and the outer ends therefore abut pin displacement means externally of the shroud.

7. An annular shroud as claimed in claim 6 wherein the abutting surfaces of the segments have opposing grooves thereby and the pins lie in said grooves with their radially inner ends abutting the grooves.

8. An annular shroud as claimed in claim 7 wherein the radially inner ends of each pin includes a bar which with the stem of the pin forms a 'T' and said bar locates in cooperating grooves which are normal to the radially aligned grooves and abuts the sides thereby.

9. An annular shroud as claimed in claim 8 wherein the pin displacement means comprises a cam ring mounted coaxially of the shroud and encircling the outer ends of the pins for movement relative thereto and adapted so that when moved the cam ring exerts or reduces a radially inwardly directed force on the pins.

10. An annular shroud as claimed in claim 9 wherein the cam ring is rotatable about the axis of the shroud for the purpose of exerting or reducing said radially inwardly directed force.

11. An annular shroud as claimed in claim 10 wherein the cam ring comprises an internal surface having scallops therein spaced so that during operation, the cam ring when rotated relative to the pins aligns said scallops with or move said scallops from the radially outer ends of respective pins.

* * * * *